US009683588B2

(12) United States Patent
Sadamori et al.

(10) Patent No.: US 9,683,588 B2
(45) Date of Patent: Jun. 20, 2017

(54) HYDRAULIC CLOSED CIRCUIT SYSTEM

(71) Applicant: HITACHI CONSTRUCTION MACHINERY CO., LTD., Tokyo (JP)

(72) Inventors: Hiroyuki Sadamori, Tokyo (JP); Juri Shimizu, Tokyo (JP); Teppei Saitoh, Tokyo (JP); Kenji Hiraku, Tsuchiura (JP); Mariko Mizuochi, Tokyo (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 377 days.

(21) Appl. No.: 14/375,219

(22) PCT Filed: Jan. 28, 2013

(86) PCT No.: PCT/JP2013/051788
§ 371 (c)(1),
(2) Date: Jul. 29, 2014

(87) PCT Pub. No.: WO2013/115140
PCT Pub. Date: Aug. 8, 2013

(65) Prior Publication Data

US 2014/0366519 A1 Dec. 18, 2014

(30) Foreign Application Priority Data

Jan. 31, 2012 (JP) ..... 2012-018728

(51) Int. Cl.
*F15B 15/18* (2006.01)
*E02F 9/22* (2006.01)
(Continued)

(52) U.S. Cl.
CPC ..... *F15B 15/18* (2013.01); *E02F 9/2207* (2013.01); *E02F 9/2271* (2013.01);
(Continued)

(58) Field of Classification Search
CPC ..... F15B 7/10; F15B 9/09; F15B 2211/611
See application file for complete search history.

(56) References Cited

U.S. PATENT DOCUMENTS 3,158,167 A * 11/1964 Redelman ..... F15B 7/10 137/101
4,343,153 A * 8/1982 Kern ..... F15B 7/10 60/460
(Continued)

FOREIGN PATENT DOCUMENTS

JP 58-57559 A 4/1983
JP 60-0181502 A 5/1985
(Continued)

OTHER PUBLICATIONS

International Preliminary Report on Patentability received in International Application No. PCT/JP2013/051788 dated Aug. 14, 2014.

*Primary Examiner* — Eric Keasel
*Assistant Examiner* — Matthew Wiblin
(74) *Attorney, Agent, or Firm* — Mattingly & Malur, PC

(57) ABSTRACT

A hydraulic closed circuit system using a single rod type hydraulic cylinder prevents the hunting of a flushing valve due to a delay in response of the flushing valve and circuit pressure pulsations, thereby preventing a decrease in operability of the hydraulic cylinder. A single rod type hydraulic cylinder is connected to a hydraulic pump via two hydraulic lines. A flushing valve is connected between the hydraulic lines and a tank; and a control unit is configured to add a predetermined control parameter to a pressure in a lower-pressure hydraulic line of the two hydraulic lines. The magnitude of a pressure in the higher-pressure hydraulic line of the two hydraulic lines is compared with the magnitude of a compensation pressure to which the control parameter has been added, and the flushing valve is switched when the
(Continued)

compensation pressure and the higher-pressure hydraulic line pressure are found to be reversed in magnitude.

14 Claims, 14 Drawing Sheets

(51) Int. Cl.
*F15B 7/00* (2006.01)
*F15B 15/20* (2006.01)
*F15B 21/00* (2006.01)

(52) U.S. Cl.
CPC ..... *E02F 9/2289* (2013.01); *E02F 9/2292* (2013.01); *F15B 7/006* (2013.01); *F15B 15/202* (2013.01); *F15B 21/005* (2013.01); *F15B 2211/20515* (2013.01); *F15B 2211/20561* (2013.01); *F15B 2211/27* (2013.01); *F15B 2211/50527* (2013.01); *F15B 2211/613* (2013.01); *F15B 2211/6313* (2013.01); *F15B 2211/7053* (2013.01)

(56) References Cited

U.S. PATENT DOCUMENTS

2010/0293937 A1* 11/2010 Ramm ..... F04B 49/002 60/431
2012/0324880 A1* 12/2012 Kuzuu ..... F15B 7/10 60/413

FOREIGN PATENT DOCUMENTS

| | | | | | |
|---|---|---|---|---|---|
| JP | 60-139902 | A | | 7/1985 | |
| JP | 60139902 | A | * | 7/1985 | ..... F15B 11/08 |
| JP | 04-290604 | A | | 10/1992 | |
| JP | 2001-002371 | A | | 1/2001 | |
| JP | 2002-021807 | A | | 1/2002 | |
| JP | 2014-95396 | A | | 5/2014 | |
| WO | 2014/045672 | A1 | | 3/2014 | |

* cited by examiner

CONVENTIONAL TECHNIQUE

CONVENTIONAL TECHNIQUE

CONVENTIONAL TECHNIQUE

CONVENTIONAL TECHNIQUE

CONVENTIONAL TECHNIQUE

CONVENTIONAL TECHNIQUE

CONVENTIONAL TECHNIQUE

HYDRAULIC CLOSED CIRCUIT SYSTEM

TECHNICAL FIELD

The present invention relates generally to hydraulic closed circuit systems, and more particularly to a hydraulic closed circuit system used for hydraulic excavators and other hydraulic work machines.

BACKGROUND ART

Conventional hydraulic closed circuit systems include those described in Japanese Patent Applications JP,A 58-57559 A (Patent Document 1) and JP-2001-2371-A (Patent Document 2).

JP,A 58-57559 A describes use of a flushing valve for controlling a surplus fluid flow developed in a hydraulic closed circuit including a single rod type hydraulic cylinder whose size of pressure-receiving areas differs between head and rod sides of the cylinder.

JP-2001-2371-A describes use of a flushing valve (equivalent to the flushing valve described in JP,A 58-57559 A) for avoiding a surplus and deficit of a fluid flow in a hydraulic closed circuit including a single rod type hydraulic cylinder having different size of pressure-receiving areas between head and rod sides of the cylinder. JP-2001-2371-A also describes use of disengaged pressure holding valves for obtaining stable actuator operation.

PRIOR ART LITERATURE

Patent Documents

Patent Document 1: JP,A 58-57559 A
Patent Document 2: JP-2001-2371-A

SUMMARY OF THE INVENTION

Problems to be Solved by the Invention

When a single rod type hydraulic cylinder that differs in size of pressure-receiving areas between head and rod sides of the cylinder is used in a hydraulic closed circuit, a surplus and deficit of a fluid flow in the circuit occur and result in unstable operation of the hydraulic cylinder. In general, therefore, as described in Patent Documents 1 and 2, a flushing valve operated by hydraulic line (circuit) pressures acting as pilot pressures upon the rod and head sides of a hydraulic cylinder controls the surplus and deficit of the fluid flow to obtain stable cylinder operation.

However, as the hydraulic cylinder speed increases, a delay in flow control due to a reason such as a lag in response of the valve itself may cause fluctuations in hydraulic cylinder speed in the flushing valve operated by the circuit pressures acting as the pilot pressures. In addition, when the flushing valve is applied to a device in which the hydraulic line pressures upon a rod side and a head side are prone to reverse in magnitude by reason of external force or the hydraulic excavator's own weight, which can be seen in a hydraulic excavator, the flushing valve frequently switches in position, such that the shock from the switching may cause unstable operation of the hydraulic cylinder. Hunting of the flushing valve due to circuit pressure pulsations may additionally occur. If these events actually happen, they will reduce operability of the hydraulic cylinder and hence that of the hydraulic work machine, for example a hydraulic excavator, that uses the hydraulic closed circuit.

An object of the present invention is to provide a hydraulic closed circuit system employing a single rod type hydraulic cylinder, the circuit system being configured to prevent hunting of a flushing valve from arising from a delay in response of the flushing valve or from circuit pressure pulsations, and thus to prevent the hydraulic cylinder from decreasing in operability.

Means for Solving the Problems

In order to solve the above problems, the present invention adopts a configuration described in CLAIMS hereof, for example.

The present invention includes a plurality of means to solve the above problems. The following provides an example of the means. A hydraulic closed circuit system includes: a prime motor; a hydraulic pump driven by the motor and adapted to deliver a hydraulic in both two directions; a single rod type hydraulic cylinder connected to the hydraulic pump via a first hydraulic line and a second hydraulic line; a tank; and a flushing valve connected between the first and second hydraulic lines and the tank, the flushing valve serving to control a surplus and deficit of a fluid flow in a lower-pressure hydraulic line of the first and second hydraulic lines. The circuit system further includes a control unit configured to add a predetermined control parameter to a pressure in the lower-pressure hydraulic line of the first and second hydraulic lines, then compare magnitude of a pressure in a higher-pressure hydraulic line of the first and second hydraulic lines with magnitude of a compensation pressure to which the control parameter has been added, and when the compensation pressure and the higher-pressure hydraulic line pressure of the first and second hydraulic lines are found to be reversed in magnitude, switch the flushing valve so as to control the surplus and deficit of the fluid flow in the lower-pressure hydraulic line.

Effects of the Invention

In the hydraulic closed circuit system of the present invention, hunting in addition to fluctuations in speed due to a delay in response of the flushing valve can be avoided and operability of the hydraulic cylinder can be enhanced.

MODE FOR CARRYING OUT THE INVENTION

Embodiments of the present invention will be described with reference to the accompanying drawings. Each of the same reference numbers in the figures relating to the embodiments of the invention denotes the same or equivalent element.

First Embodiment

A first embodiment described below relates to a hydraulic closed circuit system including a single rod type hydraulic cylinder.

Figure 1:
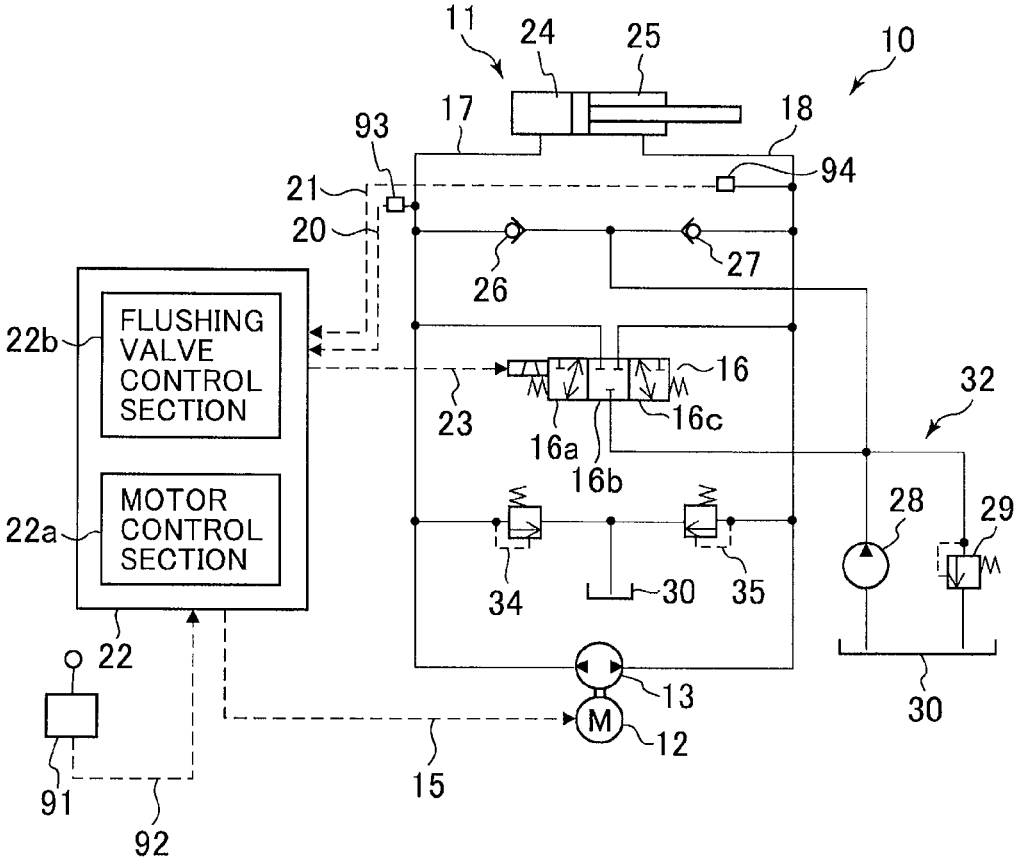
FIG. 1 shows a hydraulic closed circuit system according to a first embodiment of the present invention.

FIG. 1 shows the hydraulic closed circuit system 10 in the present embodiment.

The hydraulic closed circuit system 10 includes an electric motor 12, a bidirectionally rotatable and fixed-capacity type of hydraulic pump 13 driven by the motor 12 and equipped with two supply-discharge ports that enable the pump 13 to deliver a hydraulic fluid in two directions, and a single rod type hydraulic cylinder 11 connected to the two supply-discharge ports of the hydraulic pump 13 via hydraulic lines 17 and 18 so as to compose a closed circuit. When driven by a control signal 15 sent from a controller 22, the motor 12 directly actuates the hydraulic pump 13. The hydraulic pump 13 supplies the hydraulic operating fluid to the hydraulic cylinder 11 via at least one of the lines 17 and 18 so as to drive the cylinder 11. After being discharged from the hydraulic cylinder 11, the hydraulic operating fluid is returned to the hydraulic pump 13 via at least one of the lines 18 and 17.

The hydraulic cylinder 11 has two pressure chambers: 24 and 25. The pressure chamber 24 is a head-side pressure chamber in which a piston rod is not positioned, and the pressure chamber 25 is a rod-side pressure chamber in which the piston rod is positioned. The lines 17 and 18 are coupled to the pressure chambers 24 and 25, respectively, of the hydraulic cylinder 11.

A flushing valve 16 is connected between the lines 17, 18 and a charge circuit 32. The flushing valve 16, controlled by a control signal 23 sent from the controller 22, adjusts a surplus and deficit of the fluid flow in a lower-pressure hydraulic line of the lines 17, 18 by switching in position so as to connect the lower-pressure hydraulic line of the lines 17, 18 to the charge circuit 32. The charge circuit 32 is held at a predetermined pressure by a charge pump 28 and a relief valve 29 so that when a lack of the fluid flows in the lines 17, 18 occurs, the hydraulic operating fluid is supplied smoothly. The charge circuit 32 is also connected to inlets of check valves 26, 27 disposed on the lines 17, 18, respectively, and supplies the hydraulic operating fluid when the lack of the fluid flows in the lines 17, 18 occurs. Relief valves 34 and 35, which are also located on the lines 17 and 18, respectively, protect the hydraulic closed circuit by allowing the hydraulic operating fluid to flow into a tank 30 when internal pressures of the lines 17, 18 go over the predetermined pressure.

The controller 22 includes an electric-motor control section 22*a* and a flushing valve control section 22*b*. The motor control section 22*a* receives from a control lever device 91 an input of an operating command signal 92 which indicates operation (a moving direction and speed) of the hydraulic cylinder 11. In accordance with the operating command signal 92 that has been input as an operator's instruction from the control lever device 91, the motor control section 22*a* computes a control command value instructing a rotating direction and rotational speed of the motor 12, and then outputs a corresponding control signal 15 to the motor 12 to control the rotation of the motor. The controller 22 is thereby made to fix a delivery direction and delivery rate of the fluid from the hydraulic pump 13 in keeping with the instructions from the control lever device 91. The operating command signal 92 is also input to the flushing valve control section 22*b*. In addition to the operating command signal 92 from the control lever device 91, the flushing valve control section 22*b* receives pressure detection signals 20 and 21 that are input from pressure sensors 93 and 94 provided on the lines 17 and 18, respectively. The flushing valve control section 22*b* also computes an ON/OFF command value of the flushing valve 16 on the basis of the above input signals (the instruction from the control lever device 91 and the pressures of the lines 17, 18) and the rotation speed of the motor 12 that the motor control section 22*a* has computed (i.e., a physical quantity associated with the delivery rate of the fluid from the hydraulic pump 13). After the computation of the ON/OFF command value, the flushing valve control section 22*b* outputs a corresponding control signal 23 to the flushing valve 16 to control the switching position of the flushing valve 16.

Figure 2:
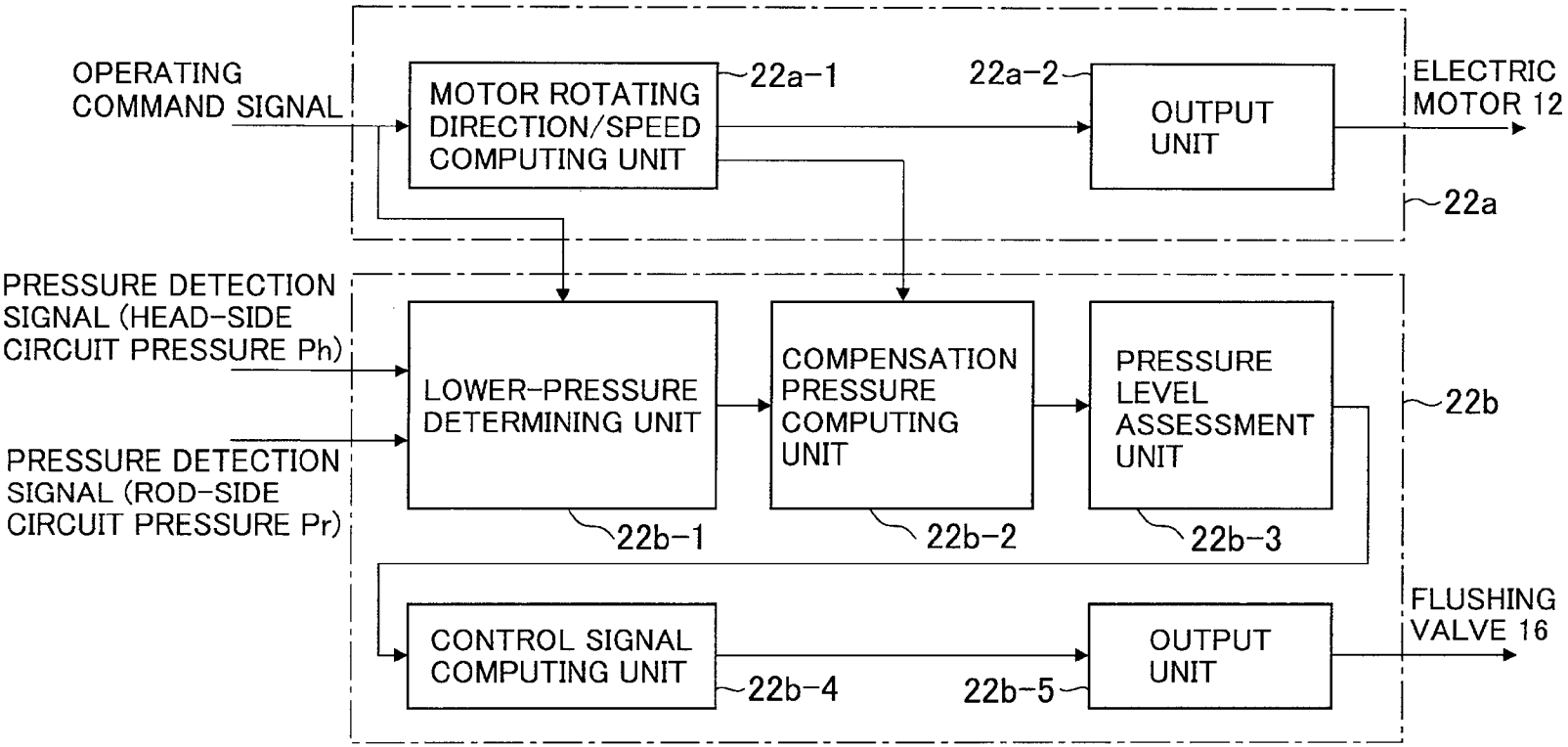
FIG. 2 shows details of processing by an electric-motor control section and flushing valve control section of a controller.

FIG. 2 shows details of processing by the motor control section 22*a* and flushing valve control section 22*b* of the controller 22.

The motor control section 22*a* has functions of a motor rotating direction/speed computing unit 22*a*-1 and an output unit 22*a*-2.

In accordance with the operating command signal 92 that has been input from the control lever device 91 as the instruction instructing the operation (a moving direction and speed) of the hydraulic cylinder 11, the motor rotating direction/speed computing unit 22*a*-1 computes the control command value on the rotating direction and rotational speed of the motor 12. The output unit 22*a*-2 outputs a control signal corresponding to the computed control command value to the motor 12.

The flushing valve control section 22*b* has functions of a lower-pressure determining unit 22*b*-1, a compensation pressure computing unit 22*b*-2, a pressure level assessment unit 22*b*-3, a control signal computing unit 22*b*-4, and an output unit 22*b*-5.

In accordance with the pressure detection signals 20, 21 sent from the pressure sensors 93, 94, respectively, the lower-pressure determining unit 22*b*-1 determines which of the lines 17, 18 has the lower pressure. In keeping with the operating command signal 92 from the control lever device 91, the lower-pressure determining unit 22*b*-1 determines whether the operating command signal 92 from the control lever device 91 instructs a start of normal rotation of the motor 12 (i.e., a start of the operation of the hydraulic cylinder 11) or reverse rotation of the motor 12 (i.e., a change of an operational direction of the hydraulic cylinder 11). When the operating command signal 92 from the control lever device 91 instructs the start of normal rotation of the motor 12 or reverse rotation of the motor 12, the lower-pressure determining unit 22*b*-1 further determines which of the lines 17, 18 has the lower pressure.

The compensation pressure computing unit 22*b*-2 adds a predetermined control parameter to the internal pressure of the lower-pressure line of the lines 17 and 18, and thus calculates a compensation pressure. In this process, the compensation pressure computing unit 22*b*-2 preferably calculates the control parameter from the rotational speed of the motor 12 that the motor control section 22*a* has computed (i.e., a physical quantity associated with the delivery rate of the fluid from the hydraulic pump 13). The control parameter in this case is calculated as a value that can be changed according to the rotational speed of the motor 12 that has been computed at the motor control section 22*a*. The compensation pressure computing unit 22*b*-2 adds the control parameter to the internal pressure of the line of the lower-pressure side. The compensation pressure computing unit 22*b*-2 may calculate, instead of the rotational speed of the motor 12, the delivery rate of the fluid from the hydraulic pump 13 and then determine the control parameter as a value that can be changed according to the calculated delivery rate of the fluid from the hydraulic pump 13. The delivery rate of the fluid from the hydraulic pump 13 can be derived from a rotational speed and capacity of the hydraulic pump 13. The rotational speed of the hydraulic pump 13 can be calculated from that of the motor 12. The capacity of the hydraulic pump 13 is constant and is a known value in case of being a fixed-capacity type.

The pressure level assessment unit 22*b*-3 conducts a comparison between the compensation pressure including the added control parameter and a pressure in the higher-pressure line of the lines 17 and 18, and assesses which of the two pressures is the higher. The control signal computing unit 22*b*-4 computes an ON/OFF command value that switches the flushing valve 16 so that the line of the lower-pressure side will be coupled to the charge circuit 32. The output unit 22*b*-5 outputs a control signal 23 corresponding to the computed ON/OFF command value to a solenoid of the flushing valve 16.

The operation of the hydraulic closed circuit system according to the present embodiment will now be described below with reference to a comparative example.

Figure 3:
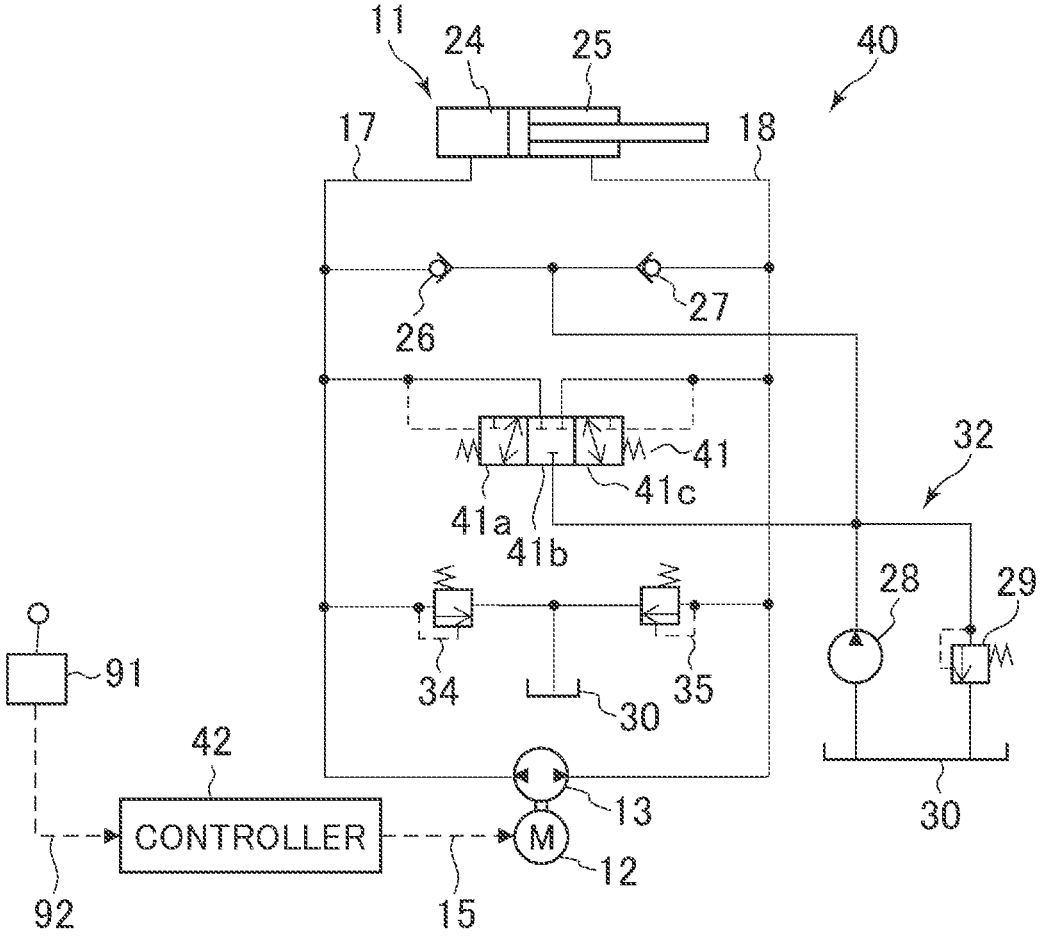
PRIOR ART FIG.3
FIG. 3 shows an example of a general hydraulic closed circuit system according to a conventional technique.

FIG. 3 shows, by way of comparison, a general hydraulic closed circuit system 40 according to a conventional technique. In FIG. 3, the elements equivalent to those of the present embodiment that are shown in FIG. 1 are assigned the same reference numbers.

An electric motor 12 is driven by a control signal 15 sent from a controller 42, whereby a bidirectionally rotatable hydraulic pump 13 is directly actuated. The hydraulic pump 13 supplies a hydraulic operating fluid to a hydraulic cylinder 11 via at least one of hydraulic lines 17 and 18, thus driving the cylinder 11. After being discharged from the hydraulic cylinder 11, the hydraulic operating fluid is returned to the hydraulic pump 13 via at least one of the lines 17, 18. A flushing valve 41 is connected between the lines 17, 18 and a charge circuit 32, and internal pressures of the lines 17, 18 are guided as pilot pressures into the flushing valve 41. When the line 18 has a lower internal pressure than the line 17, therefore, the flushing valve 41 is set to a position 41*a* to establish communication between the line 18 and the charge circuit 32. On the contrary, when the line 17 has a lower internal pressure, the flushing valve 41 is set to a position 41*c* to establish communication between the line 17 and the charge circuit 32.

The operation of the hydraulic closed circuit system according to the conventional technique is described below with reference to FIGS. 4 to 9. FIGS. 4 to 9 show an example of arm crowding in which the hydraulic cylinder 11, used as an arm cylinder of a hydraulic excavator, is progressively extended from a fully retracted state.

Figure 4:
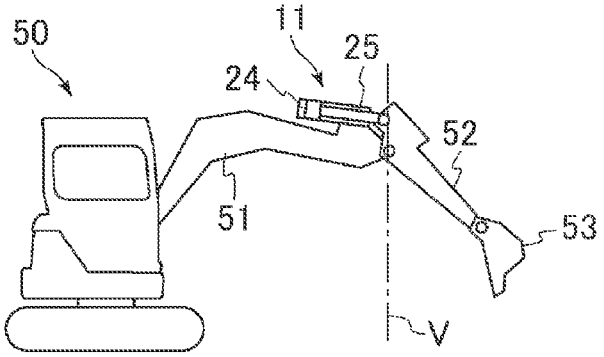
PRIOR ART FIG.4
FIG. 4 shows a hydraulic excavator according to the conventional technique having its arm to be in a position before the arm reaches a vertical line passing through a pin connection between a boom and the arm during arm crowding where a hydraulic cylinder is progressively extended from a fully retracted state.
Figure 6:
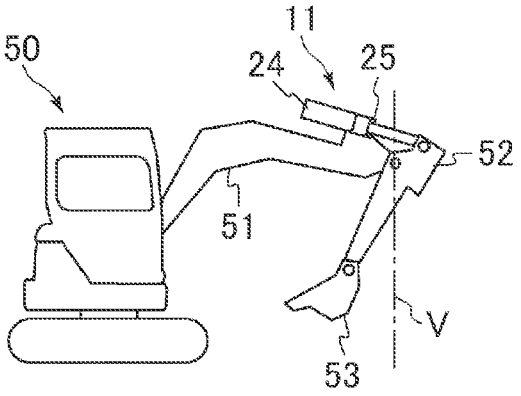
PRIOR ART FIG.6
FIG. 6 shows a hydraulic excavator having its arm to be in a position after the arm reaches a vertical line passing through a pin connection between a boom and the arm during arm crowding where a hydraulic cylinder is progressively extended from a fully retracted state.

As shown in FIGS. 4 and 6, the hydraulic excavator 50 includes a boom 51, an arm 52, and a bucket 53 which are parts of a front work implement. The boom 51 is pin-connected at its proximal end to a vehicle body, and at its distal end to a proximal end of the arm 52, and the arm 52 is pin-connected at its distal end to the bucket 53. The arm 52 is driven by the hydraulic cylinder 11 (arm cylinder) to move vertically with respect to the boom 51. Illustrations of other drivers such as hydraulic cylinders of the boom 51 and the bucket 53 are omitted.

Figure 5:
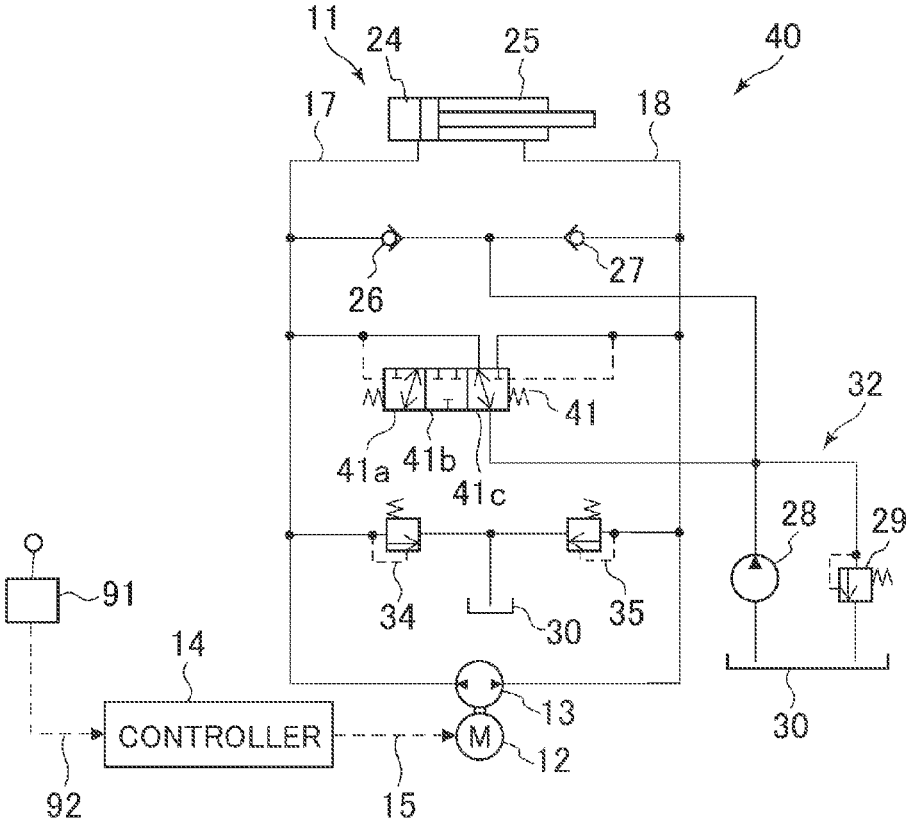
PRIOR ART FIG.5
FIG. 5 shows a state that the hydraulic closed circuit system takes up when the arm is in the position shown in FIG. 4.
Figure 7:
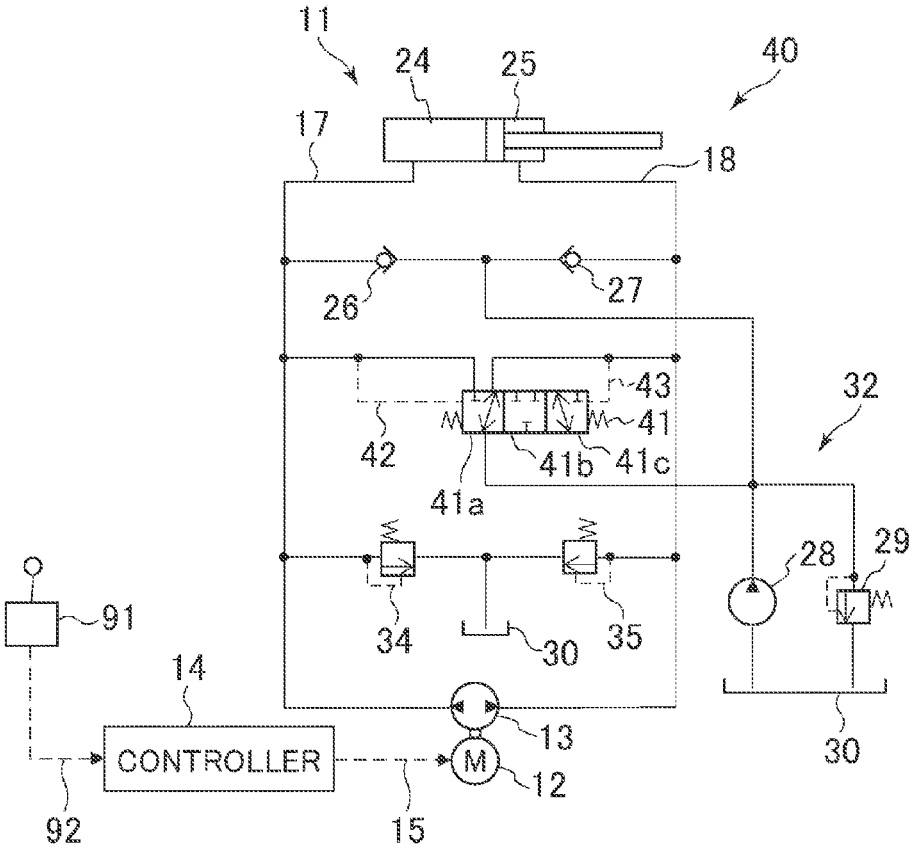
PRIOR ART FIG.7
FIG. 7 shows a state that the hydraulic closed circuit system takes up when the arm is in the position shown in FIG. 6.
Figure 8:
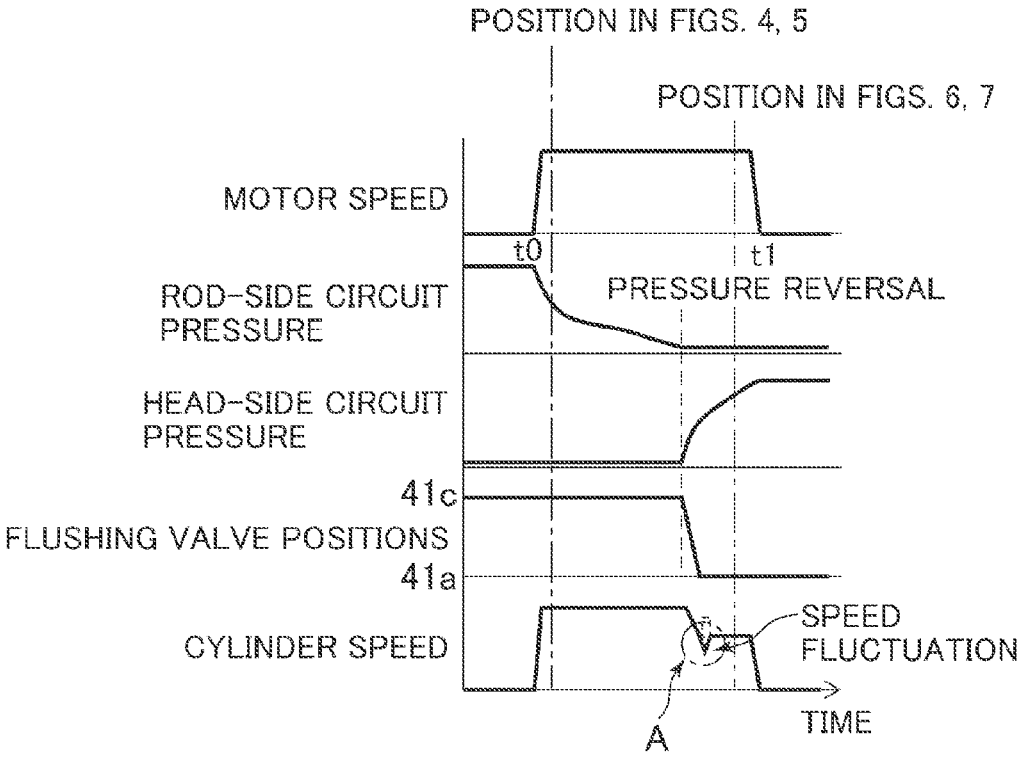
PRIOR ART FIG.8
FIG. 8 shows time-series data on an electric motor speed, rod-side circuit pressure, head-side circuit pressure, flushing valve position, and cylinder speed detected during the arm crowding in a general hydraulic closed circuit system according to the conventional technique.
Figure 9:
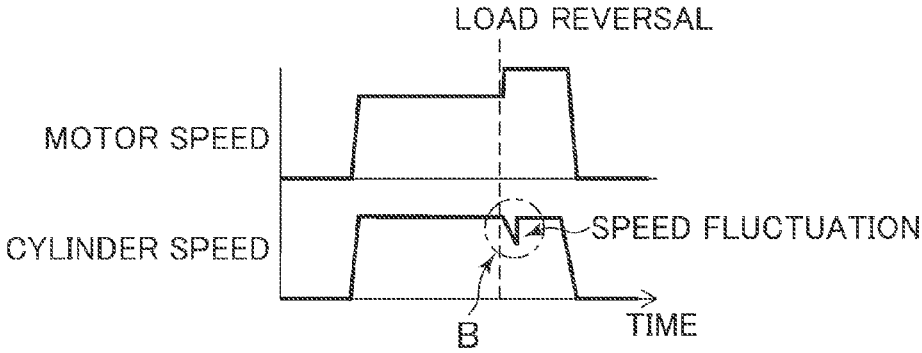
PRIOR ART FIG.9
FIG. 9 shows time-series data on an electric motor speed and cylinder speed detected with a measure taken to prevent the cylinder speed from decreasing after load reversal in the general hydraulic closed circuit system according to the conventional technique.

FIG. 4 shows a hydraulic excavator according to the conventional technique having its arm to be in a position before the arm reaches a vertical line passing through a pin connection between a boom and the arm during arm crowding where a hydraulic cylinder is progressively extended from a fully retracted state. FIG. 5 shows a state that the hydraulic closed circuit system 40 takes up when the arm 52 is in the position shown in FIG. 4. FIG. 6 shows a hydraulic excavator according to the conventional technique having its arm to be in a position after the arm reaches a vertical line passing through a pin connection between a boom and the arm during arm crowding where a hydraulic cylinder is progressively extended from a fully retracted state. FIG. 7 shows a state that the hydraulic closed circuit system 40 takes up when the arm 52 is in the position shown in FIG. 6. FIG. 8 shows time-series data on an electric motor speed, rod-side circuit pressure, head-side circuit pressure, flushing valve position, and cylinder speed detected during arm crowding. FIG. 9 shows time-series data on an electric motor speed and cylinder speed detected with a measure taken to prevent the cylinder speed from decreasing after load reversal.

When the arm 52 is in the position shown in FIG. 4, weights of elements such as the arm 52 and bucket 53 act as driving force upon the hydraulic cylinder 11. When the arm 52 is in the position shown in FIG. 6, the weights of the arm 52 and bucket 53 act as a load upon the hydraulic cylinder 11.

In the position of the arm 52 in FIG. 4, even when the hydraulic cylinder 11 changes a position in its extending direction as shown in FIG. 8, since the weights of the elements such as the arm 52 and bucket 53 act as driving force, circuit pressures in a rod-side pressure chamber 25 of the hydraulic cylinder 11 and in the line 18 (rod-side circuit) connected to the pressure chamber 25 become higher than circuit pressures applied to a head-side pressure chamber 24 of the hydraulic cylinder 11 and in the line 17 (head-side circuit) connected to the pressure chamber 24. Accordingly, the pilot pressure that has been guided from the line 18 switches the flushing valve 16 to the position 41*c* to establish communication between the line 17 of the lower-pressure side and the charge circuit 32. At this time, a difference in size of pressure-receiving areas between the head-side pressure chamber 24 and rod-side pressure chamber 25 of the hydraulic cylinder 11 poses an deficit of the fluid flow in the head-side circuit of the lower pressure side, hence causing the hydraulic operating fluid to be supplied from the charge circuit 32 to the head-side circuit.

Since the weights of the arm 52 and bucket 53 act as the load upon the hydraulic cylinder 11 in the position of the arm 52 in FIG. 6 showing the extended hydraulic cylinder 11, the head-side circuit pressure and the rod-side circuit pressure reverse in magnitude, resulting in the head-side circuit pressure being the higher than the rod-side circuit pressure. This reverse switches the flushing valve 16 to the position 41*a* to establish communication between the line 18 of the lower-pressure side and the charge circuit 32. At this time, a difference in size of pressure-receiving areas between the head-side pressure chamber 24 and rod-side pressure chamber 25 of the hydraulic cylinder 11 poses a deficit fluid flow in the rod-side circuit of the lower pressure side, hence causing the hydraulic operating fluid to be supplied from the charge circuit 32 to the rod-side circuit.

When the hydraulic cylinder 11 is being retracted, the head-side circuit, while being in the position of FIG. 4, has the lower pressure; and the rod-side circuit, while being in the position of FIG. 6, has a lower pressure. At this time, the difference in size of pressure-receiving areas between the head-side pressure chamber 24 and rod-side pressure chamber 25 of the hydraulic cylinder 11 poses, in contrast to the deficit fluid flow in an extended state of the hydraulic cylinder 11, a surplus fluid flow in the circuit of the lower pressure side (corresponding to the head-side circuit in the position of FIG. 4; the rod-side circuit in the position of FIG. 6). In this state, the hydraulic operating fluid is discharged from the circuit of the lower-pressure side into a tank 30 when the flushing valve 41 operates in such a manner that the pressure in the lower-side circuit connected to the charge circuit 32 will go over a set pressure of a relief valve 29. In addition, the flushing valve 41 switches in position when the reversal of magnitude between the head-side circuit pressure and the rod-side circuit pressure (i.e., the pressures in the lines 17, 18) occurs in the same manner as the hydraulic cylinder 11 extending.

In this way, the flushing valve 41 works to control the surplus and deficit of a fluid flow that occur when the single rod type hydraulic cylinder having the two pressure chambers 24, 25 of the different pressure-receiving area size is used in the closed circuit.

Since the pressure chamber that is higher in thrust will be a control side, the speed of the hydraulic cylinder 11 in its extended state is determined on the basis of, in the position of FIG. 4, a flow rate of the fluid flowing out from the rod-side pressure chamber 25. And the speed is depended on a flow rate of the fluid flowing into the head-side pressure chamber 24 in the position of FIG. 6. In a case that the motor 12 rotates at a constant speed, therefore, when the load reversal causing a switchover of the control-side pressure chamber occurs as shown in FIG. 8, the speed of the hydraulic cylinder 11 decreases in proportion to pressure-receiving area ratio. Meanwhile, in a neighboring region of the load reversal the pressures in the head-side circuit and the rod-side circuit reverse in magnitude and the flushing valve 41 switches in position when the load reversal causing a switchover of the control-side pressure chamber occurs as above. If a delay in response of the flushing valve 41 induces a lag in the control of the surplus and deficit of the fluid flow, a transient fluctuation in the speed of the hydraulic cylinder 11 occurs in the vicinity of the load reversal, as denoted by reference symbol A in FIG. 8. For example, even when the speed is adjusted with a delay in operation of the motor 12 taken into consideration, if the flow control function of the flushing valve 41 fails to operate properly, a transient speed fluctuation occurs in the hydraulic cylinder 11. This transient speed fluctuation, arising in opposition to an operator's operation on the hydraulic excavator, leads to lower operability of the excavator. Additionally, as described above, at least one of the head-side circuit pressure and the rod-side circuit pressure operates as a pilot pressure of the flushing valve, for which reason hunting due to pressure pulsations in these circuits may arise to vibrate the hydraulic cylinder 11.

Furthermore, in order to prevent the speed of the hydraulic cylinder 11 from decreasing when the load reversal occurs to cause the switchover of the control-side pressure chamber, the speed of the motor 12 is generally enhanced for increased delivery flow from the hydraulic pump 13, in such load-reversal timing as shown in an upper row of FIG. 9. The enhancement of the motor speed maintains a constant speed of the hydraulic cylinder 11, thus preventing operability from decreasing. Even in this case, however, because the reversal of magnitude between the head-side circuit pressure and the rod-side circuit pressure occurs in the vicinity of the load reversal and causes the position of the flushing valve 41 to switch, if a delay in the response of the flushing valve 41 occurs and this delay causes a delay in the control of the surplus and deficit of the fluid flow, a transient fluctuation in the speed of the hydraulic cylinder 11 occurs in the vicinity of the load reversal, as denoted by reference symbol B in a lower row of FIG. 9. The transient speed fluctuation in this case also brings about the problem of the hydraulic excavator decreasing in operability, or hunting of the flushing valve 41 resulting in the vibration of the hydraulic cylinder 11.

The operation of the hydraulic closed circuit system according to the present embodiment will now be described below.

Figure 10:
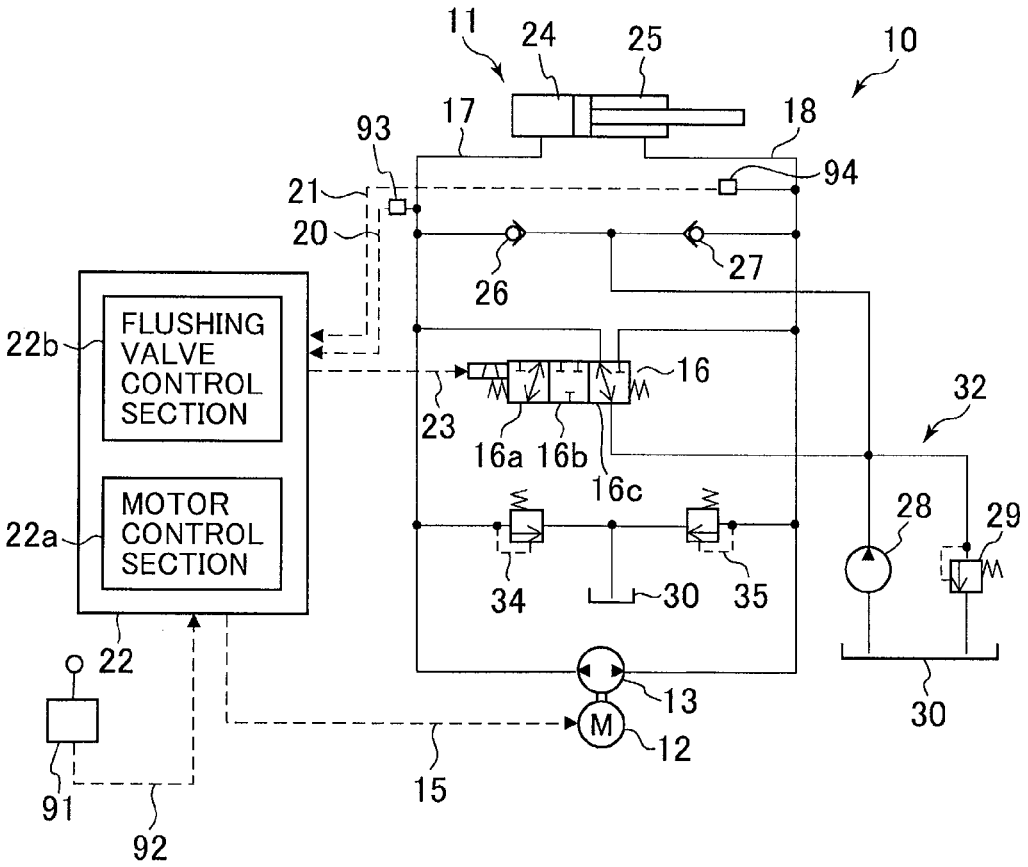
FIG. 10 shows a state that the hydraulic closed circuit system takes up when the arm is in such position as in FIG. 4.
Figure 11:
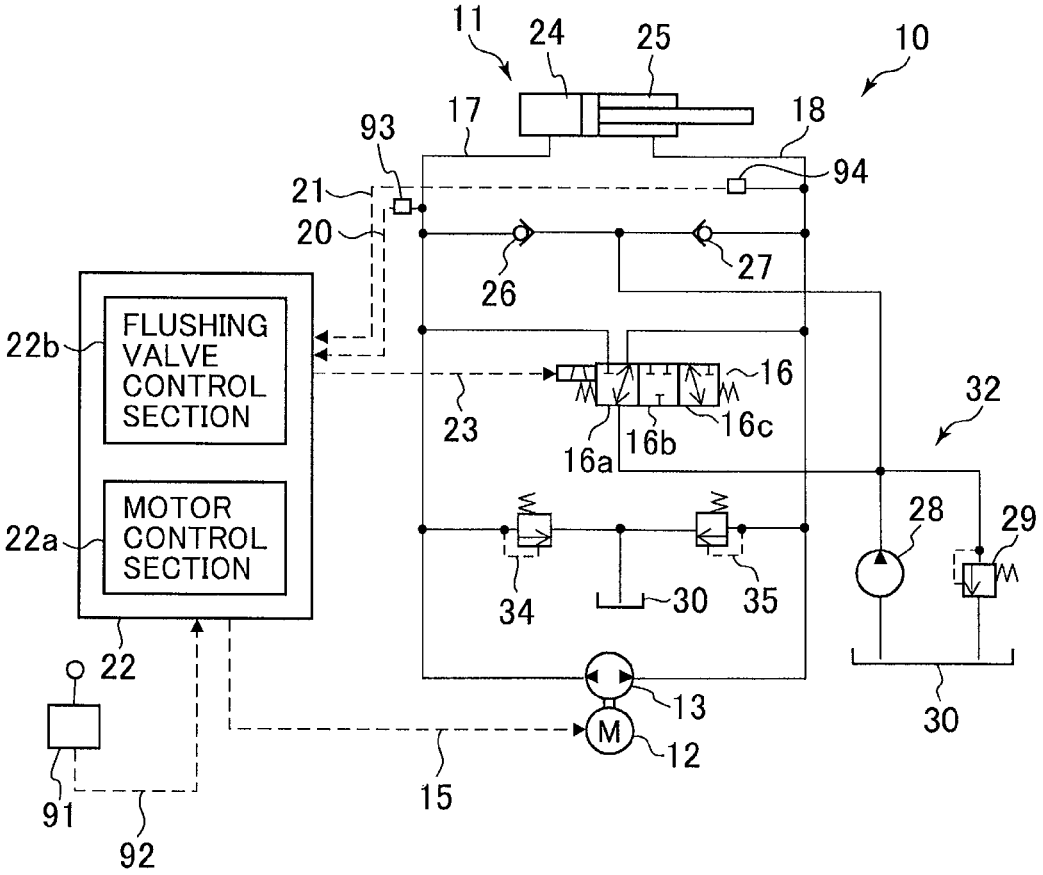
FIG. 11 shows a state that the hydraulic closed circuit system takes up when the arm is in such position as in FIG. 6.
Figure 12:
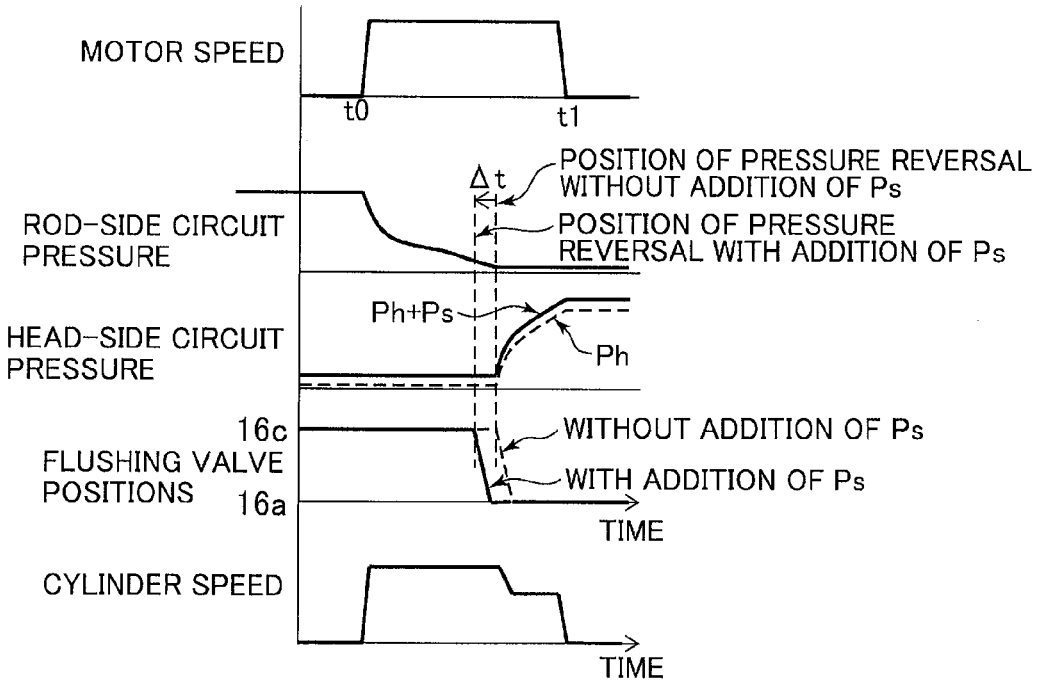
FIG. 12 shows time-series data on an electric motor speed, rod-side circuit pressure, head-side circuit pressure, flushing valve position, and cylinder speed detected during arm crowding in the hydraulic closed circuit system according to the first embodiment of the present invention.
Figure 13:
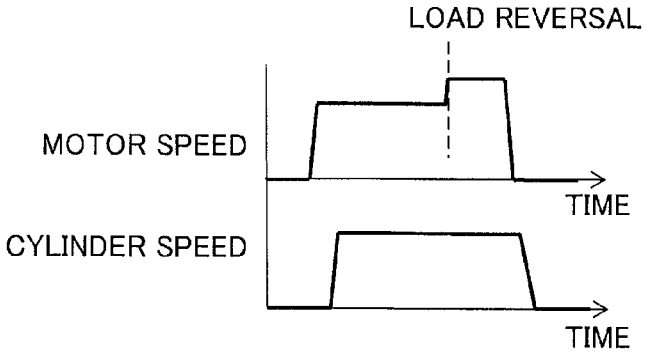
FIG. 13 shows time-series data on an electric motor speed and cylinder speed detected with a measure taken to prevent the cylinder speed from decreasing after load reversal in the first embodiment of the present invention.

FIG. 10 shows a state that the hydraulic closed circuit system 10 according to the takes up when the arm 52 is in the position shown in FIG. 4. FIG. 11 shows a state that the hydraulic closed circuit system 10 takes up when the arm 52 is in the position shown in FIG. 6. FIG. 12, as with FIG. 8, shows time-series data on an electric motor speed, rod-side circuit pressure, head-side circuit pressure, flushing valve position, and cylinder speed detected during arm crowding. FIG. 13, as with FIG. 9, shows time-series data on an electric motor speed and cylinder speed detected with a measure taken to prevent the cylinder speed from decreasing after load reversal.

As described above, the weights of the elements such as the arm 52 and bucket 53 act as the driving force upon the hydraulic cylinder 11 during arm crowding where the position of the hydraulic cylinder 11 is displaced in its extending direction when the arm 52 is in the position shown in FIG. 5. The rod-side circuit pressure will be higher than the head-side circuit pressure accordingly. The weights of the arm 52 and bucket 53 act as the load upon the hydraulic cylinder 11 with the arm 52 being in the position of FIG. 6 showing the hydraulic cylinder 11 extending. The head-side circuit pressure and the rod-side circuit pressure accordingly reverse in magnitude, whereby the head-side circuit pressure will be higher than the rod-side circuit pressure.

If the pressure in the head-side circuit (line 17) of the hydraulic cylinder 11 is taken as Ph, and the pressure in the rod-side circuit (line 18) is taken as Pr, then extending the hydraulic cylinder 11 so as to obtain the same valve operation as that of the flushing valve 41 in the conventional system of FIG. 3 can be accomplished in the following way. Which of the pressure Ph in the head-side circuit (line 17) and the pressure Pr in the rod-side circuit (line 18) is lower is first determined. If Ph>Pr, the control signal 23 is applied to switch the flushing valve 16 to be in a position 16*a* (see FIG. 11); if Ph=Pr, the control signal 23 is applied to switch the flushing valve 16 to be in a position 16*b*; and if Ph<Pr, the control signal 23 is applied to switch the flushing valve 16 to be in a position 16*c* (see FIG. 10).

In the present embodiment, the lower-pressure determining unit 22*b*-1 of the flushing valve control section 22*b* in the controller 22 and the flushing valve control section 22*b* undertake substantially the same lower-pressure determination and same flushing-valve position switching of the flushing valve 16, respectively, as those described above. Thus the flushing valve 16 in the present embodiment can also control the surplus and deficit of a fluid flow that occur when the single rod type hydraulic cylinder having the two pressure chambers 24, 25 of the different pressure-receiving area sizes is used in the closed circuit.

However, merely the switching of the flushing valve 16 before the determination based on the comparison between the pressure Ph in the head-side circuit (line 17) and the pressure Pr in the rod-side circuit (line 18) will lead to a velocity fluctuation due to a delay in the response of the flushing valve 16 or further lead to hunting of the flushing valve 16. In the present embodiment, therefore, for the sake of suppressed velocity fluctuation due to a delay in the response of the flushing valve 16, the predetermined control parameter is added to the lower-pressure side of the pressure Ph of the head-side circuit (line 17) and the pressure Pr of the rod-side circuit (line 18) before the two pressures are compared. After this comparison, the control signal 23 is computed and the timing of the connection between the circuit of the lower-pressure side and the charge circuit 32 is advanced.

The above explanation will be described in detail below.

In the present embodiment the control parameter Ps is introduced to suppress the velocity fluctuation, and the lower-pressure determining unit 22*b*-1 of the flushing valve control section 22*b* in the controller 22 determines which is the lower of the pressure Ph in the head-side circuit (line 17) and the pressure Pr in the rod-side circuit (line 18). After that, when the operating command signal 92 from the control lever device 91 instructs the start of the normal rotation of the motor 12 (i.e., the start of the operation of the hydraulic cylinder 11) or the reverse rotation of the motor 12 (i.e., the change of a particular operational direction of the hydraulic cylinder 11), the compensation pressure computing unit 22*b*-2 adds the predetermined control parameter to the pressure of the line of the lower-pressure side. After this, the pressure level assessment unit 22*b*-3 assesses, by comparison, which of the following two pressures is the higher: the compensation pressure including the added control parameter; and the higher line pressure between the pressure Ph in the head-side circuit (line 17) and the pressure Pr in the rod-side circuit (line 18). Furthermore, assuming the pressure Ph of the head-side circuit (line 17) is lower than the pressure Pr of the rod-side circuit (line 18), the control signal computing unit 22*b*-4 gives the appropriate control signal 23 so that: when Ph+Ps>Pr, the flushing valve 16 will switch to be in the position 16*a*; when Ph+Ps=Pr, the flushing valve 16 will switch to be in the position 16*b*; and when Ph+Ps<Pr, the flushing valve 16 will switch to be in the position 16*c*. That is to say, after the control parameter Ps is added to the head-side circuit pressure, the control signal computing unit 22*b*-4 compares the magnitude of pressure and switches the flushing valve 16.

Those operations elevate the head-side circuit pressure by the control parameter Ps, as shown in FIG. 12. Consequently, the timing at which the magnitude of the head-side circuit pressure and that of the rod-side circuit pressure reverse is advanced by a time Δt. The flushing valve 16 is switched correspondingly earlier than when the control parameter Ps is not added. In addition, a fluctuation in the speed of the hydraulic cylinder 11 due to a delay in the response of the flushing valve 16 is reduced. Furthermore, hunting of the flushing valve 16 can be prevented and the operation of the flushing valve 16 can be stabilized for improved operability of the hydraulic cylinder 11.

Moreover, if the delivery rate of the fluid from the hydraulic pump 13 is enlarged by changing the speed of the motor 12 while allowing for the timing of the load reversal and for a delay in response of the motor 12 as shown in FIG. 13, then the velocity of the hydraulic cylinder 11 can be constant even after the load reversal. The operability of the hydraulic cylinder 11 can be enhanced as well. The speed of the motor 12 at this time may be calculated from the pressure-receiving areas of the head-side pressure chamber 24 and the rod-side pressure chamber 25 with the moving direction of the hydraulic cylinder 11 taken into consideration. This control can be conducted with the motor rotating direction/speed computing unit 22*a*-1 of the motor control section 22*a*. Whether the load has reversed can be recognized from a result of the assessment done by the pressure level assessment unit 22*b*-3 of the flushing valve control section 22*b*.

Next, a description is given below of an example in which the control parameter Ps is varied according to a particular rotational speed of the motor 12.

The appropriate rotational speed of the motor 12 can be obtained in keeping with the particular operating command signal 92 from the control lever device 91. If the control parameter Ps for a high rotational speed is used for a low rotational speed, however, the speed of the hydraulic cylinder 11 is estimated to become unstable during load reversal. In consideration of this status, highly stable operation can be obtained by setting an appropriate control parameter Ps for the particular rotational speed of the motor 12.

Figure 14:
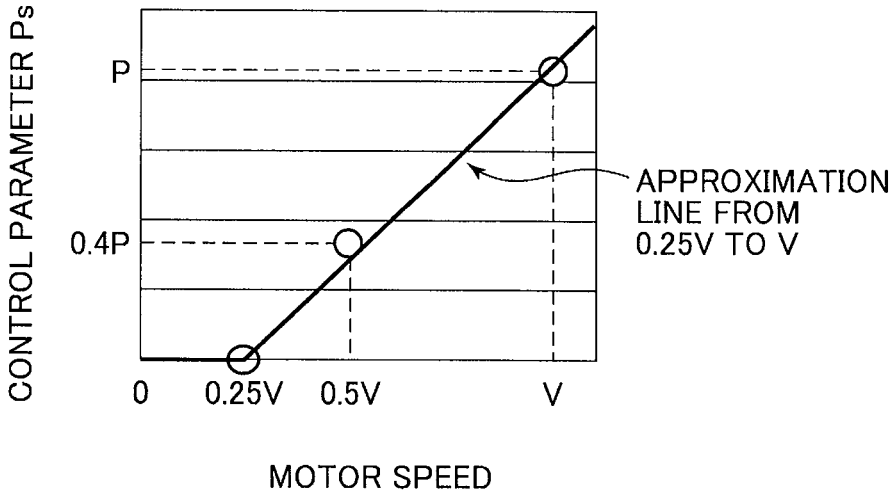
FIG. 14 shows plotting that represents analytically calculated values of a control parameter Ps which yields high stability for the rotational speed of the motor 12.

FIG. 14 shows plotting that represents analytically calculated values of the control parameter Ps which yields high stability for the rotational speed of the motor 12.

FIG. 4 uses a horizontal axis to represent the rotational speed of the motor 12, a vertical axis to represent the control parameter Ps, circled points (○) to represent the analytically calculated values of the control parameter Ps which yields high stability for the rotational speed of the motor 12, and a line to represent an approximation formula obtained from the circled points.

The compensation pressure computing unit 22*b*-2 of the flushing valve control section 22*b* in the controller 22 has characteristics shown in FIG. 14, and uses the characteristics to calculate the control parameter Ps from the rotational speed of the motor 12 that is a physical quantity related to the delivery rate of the fluid from the hydraulic pump 13. FIG. 14 indicates that: when the rotational speed of the motor 12 is V, the control parameter Ps takes a value of P; when the rotational speed of the motor 12 is 0.5 V, the control parameter Ps takes a value of 0.4 P; when the rotational speed of the motor 12 is 0.25 V, the control parameter Ps takes a value of 0; and until the rotational speed of the motor 12 has exceeded 0.25 V, the control parameter Ps takes the value of 0. The rotational speed range of the motor 12 from 0.25 V to V, and the control parameters Ps in this range are first used to execute linear approximation. A desired control parameter Ps is then calculated from the approximation formula. Whereas the linear approximation is used in the present example, any other appropriate method of approximation may be used instead. The appropriate control signal 23 is given so that: when Ph+Ps>Pr, the flushing valve 16 will switch to be in the position 16*a*; when Ph+Ps=Pr, the flushing valve 16 will switch to be in the position 16*b*; and when Ph+Ps<Pr, the flushing valve 16 will switch to be in the position 16*c*. These operations will provide stable hydraulic-cylinder operation in a wide rotational speed range of the motor 12.

FIG. 14 also indicates that the hydraulic cylinder 11 operates at relatively low speeds when the motor 12 rotates at speeds up to 0.25 V. A delay in the response of the flushing valve 16 is ignorable in relative perspective accordingly, and hence the control parameter Ps may be set to equal 0. This setting will allow the stability in the control during low speed operation to be ensured.

The determination regarding to which of the pressure Ph in the head-side circuit (line 17) or the pressure Pr in the rod-side circuit (line 18) the control parameter Ps is to be added—that is, the determination on which of the pressure in the head-side circuit (line 17) or the pressure in the rod-side circuit (line 18) is the lower—is preferably made when the motor 12 is started (the hydraulic cylinder 11 is started) or when the rotating direction of the motor 12 changes (the moving direction of the hydraulic cylinder 11 changes). As described above, this determination is conducted by the lower-pressure determining unit 22*b*-1 of the flushing valve control section 22*b* in the controller 22.

When the control lever device 91 is frequently operated to start and stop the motor or to change the rotating direction of the motor, the lower-pressure determining unit 22*b*-1 of the flushing valve control section 22*b* maintains a current determination result without repeating the above determination before a certain amount of time passes (a processing delay region). The event that the flushing valve 16 frequently switches to make the hydraulic cylinder 11 oscillatory can be avoided by the processing delay.

While the description based on the extending hydraulic cylinder 11 has been given above, the same as above also applies to the retracting hydraulic cylinder 11. That is to say, the appropriate control parameter Ps may be calculated by analysis, measurement, or other methods, and then the control parameter Ps may be appropriately used according to the particular rotating direction of the motor 12 (moving direction of the hydraulic cylinder 11). The control parameter Ps may otherwise be appropriately used in keeping with a particular operating direction of the control lever device 91, instead of the rotating direction of the motor 12.

In addition, while the example of using an approximation formula to calculate the control parameter Ps has heretofore been described in the present embodiment, an appropriate control parameter based on linear interpolation, for example, may be calculated after storing, as a map, control parameter data settings for the motor speed (a physical quantity related to the delivery rate of the fluid from the hydraulic pump 13).

Controlling the flushing valve 16 so as to be in the position 16*b* when the motor 12 stops rotating will allow a position of the hydraulic cylinder 11 to be held since the hydraulic operating fluid can be deterred from flowing into and out from the flushing valve 16.

Although a relation between the speed of the motor 12 and the control parameter Ps has been used in the present embodiment, the delivery rate of the fluid from the hydraulic pump 13 may be first calculated from the pressures of the lines 17, 18 and the speed of the motor 12. And then a relation between the delivery rate of the fluid from the hydraulic pump 13 and the control parameter Ps may be used thereafter.

Second Embodiment

Another embodiment of the present invention that employs a single rod type hydraulic cylinder in a hydraulic closed circuit system will be described below.

Figure 15:
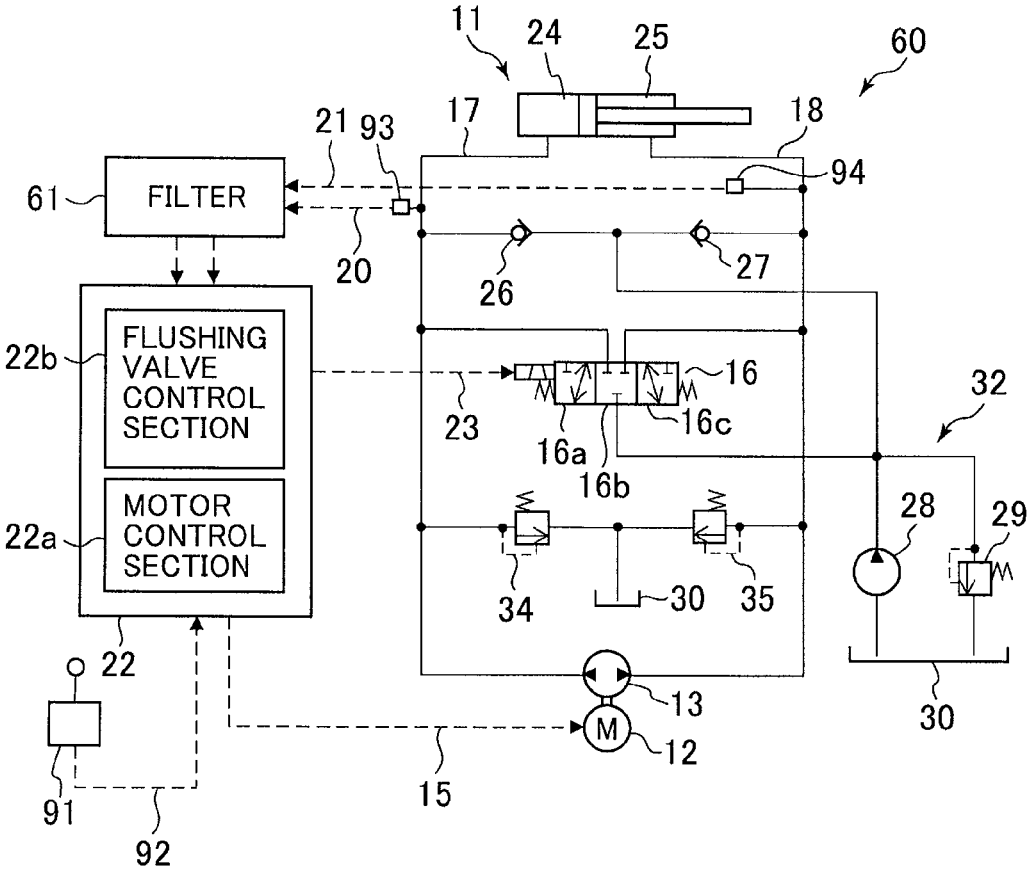
FIG. 15 shows a hydraulic closed circuit system according to a second embodiment of the present invention.

FIG. 15 shows the hydraulic closed circuit system 60 of the present embodiment. Of the hydraulic closed circuit system 60 shown in FIG. 15, elements assigned the same reference numbers in the above-described figures, and elements having the same functions as in the figures are omitted from FIG. 15.

The present embodiment has substantially the same basic structure as that of the first embodiment shown in FIG. 1, and only differs from the first embodiment of FIG. 1 in that pressure detection signals 20, 21 from the pressure sensors 93, 94, respectively, pass through a filter 61 before being input to the controller 22. For example, if the filter 61 is a low-pass filter, effects of pressure pulsations exceeding a cutoff frequency of the filter 61 are suppressed in the control signal 23 and thus the operation of the flushing valve 16 stabilizes. This, in turn, further reduces vibration of the hydraulic cylinder 11 due to a switching shock of the flushing valve 16, hence enhancing the operability of the hydraulic cylinder 11.

Third Embodiment

Yet another embodiment of the present invention that employs a single rod type hydraulic cylinder in a hydraulic closed circuit system will be described below.

Figure 16:
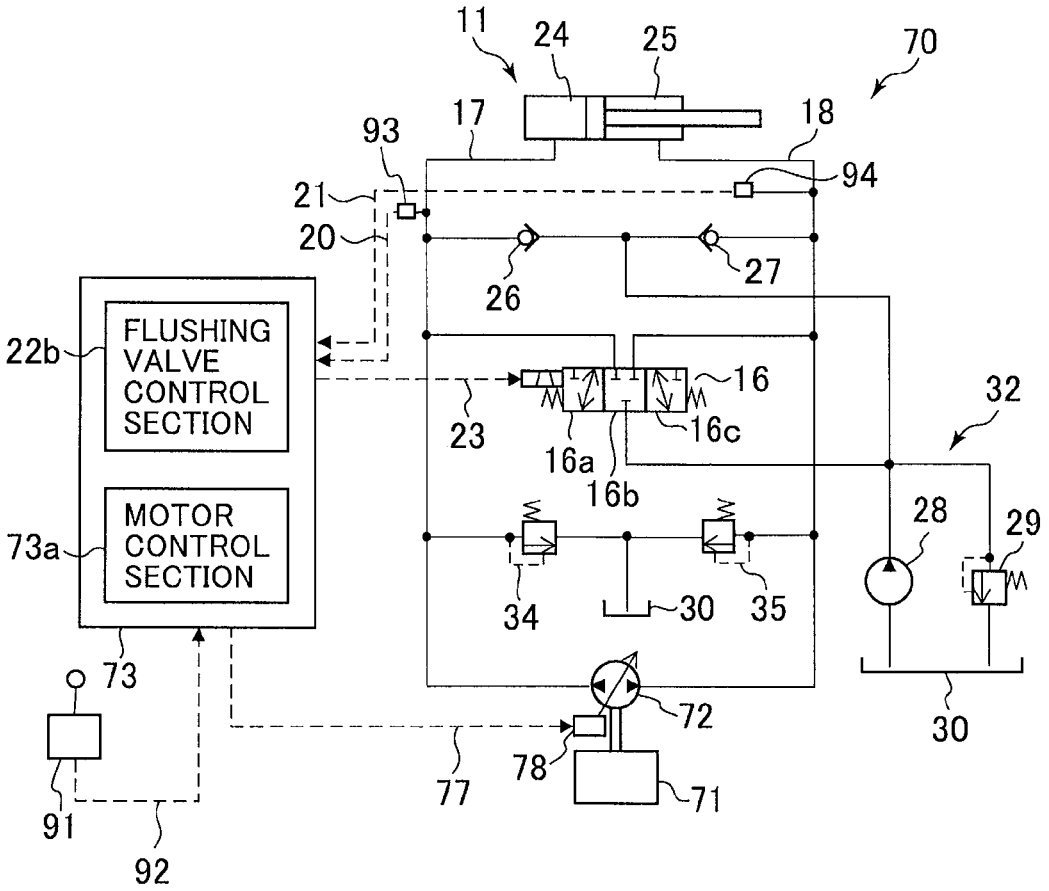
FIG. 16 shows a hydraulic closed circuit system according to a third embodiment of the present invention.

FIG. 16 shows the hydraulic closed circuit system 70 of the present embodiment. Of the hydraulic closed circuit system 70 shown in FIG. 16, elements assigned the same reference numbers in the above-described figures, and elements having the same functions as in the figures are omitted from FIG. 16.

The hydraulic closed circuit system of the present embodiment differs from the hydraulic closed circuit system 10 of FIG. 1 in that an engine (prime mover) 71 drives a bidirectionally tiltable hydraulic pump 72 adapted to change its delivery rate of a fluid. The engine 71 has its target speed set from a control device not shown, such as an engine control dial, and its fuel injection rate controlled by a fuel injector such as an electronic governor, whereby its speed and torque are controlled as a result.

The bidirectionally tiltable hydraulic pump 72 is suitable for driving the engine, since this pump is designed so that even when it is rotating at a fixed speed in a fixed direction, directions and rates of fluid delivery and suction can be changed by changing a tilting direction and tilt angle of the pump. The hydraulic pump 72 includes a regulator 78 for changing the tilting direction and tilt angle of the pump.

A controller 73 includes a pump tilt control section 73*a* and a flushing valve control section 73*b*. The pump tilt control section 73*a* first receives an input of an operating command signal 92 instructing the operation (moving direction and speed) of the hydraulic cylinder 11 from the control lever device 91. After computing a control command value for the tilting direction and tilt angle of the bidirectionally tiltable hydraulic pump 72 in accordance with the operating command signal 92 (an instruction from the control lever device 91), the pump tilt control section 73*a* outputs a relevant control signal 77 to the regulator 78 of the hydraulic pump 72 and controls a tilt of the pump 72. Thus the controller 73 controls the fluid delivery direction and fluid delivery rate of the hydraulic pump 72 in accordance with the instruction from the control lever device 91. The flushing valve control section 73*b* receives the operating command signal 92 and the pressure detection signals 21, 22 that are input from the pressure sensors 93 and 94 provided on the lines 17 and 18, respectively. The flushing valve control section 73*b* also computes an ON/OFF command value of the flushing valve 16, on the basis of the above input signals (the instruction from the control lever device 91 and the pressures of the lines 17, 18) and the tilt angle of the hydraulic pump 72 that the pump tilt control section 73*a* has computed (i.e., a physical quantity associated with the delivery rate of the fluid from the hydraulic pump 72). After the computation of the ON/OFF command value, the flushing valve control section 73*b* outputs a corresponding control signal 23 to the flushing valve 16 to control the switching position of the flushing valve 16.

Figure 17:
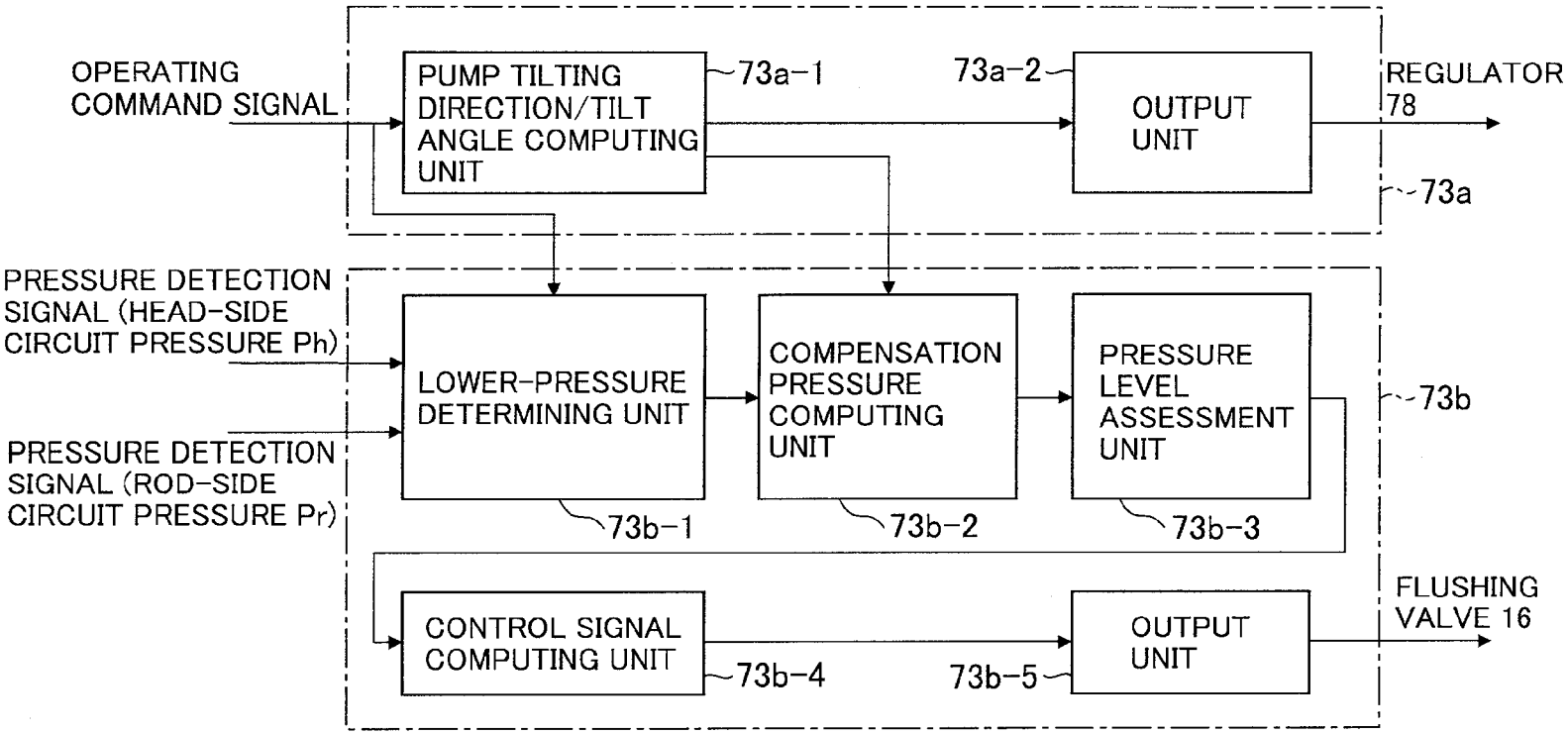
FIG. 17 shows details of processing by a pump tilt control section and flushing valve control section of a controller.

FIG. 17 shows details of processing by the pump control section 73*a* and flushing valve control section 73*b* of the controller 73.

The pump tilt control section 73*a* has functions of a pump tilting direction/tilt angle control unit 73*a*-1 and an output unit 73*a*-2.

The pump tilting direction/tilt angle control unit 73*a*-1 computes the control command value for the tilting direction and tilt angle of the hydraulic pump 72 in accordance with the operating command signal 92 instructing the operation (moving direction and speed) of the hydraulic cylinder 11 from the control lever device 91. The output unit 73*a*-2 outputs a control signal corresponding to the control command value to the regulator 78 of the hydraulic pump 72.

The flushing valve control section 73*b* has functions of a lower-pressure determining unit 73*b*-1, a compensation pressure computing unit 73*b*-2, a pressure level assessment unit 73*b*-3, a control signal computing unit 73*b*-4, and an output unit 73*b*-5. Except for the compensation pressure computing unit 73*b*-2, the functions of these elements are substantially the same as those of the first embodiment shown in FIG. 2.

In the compensation pressure computing unit 73*b*-2, instead of the rotational speed of the motor 12 that the motor control section 22*a* has computed, the tilt angle of the hydraulic pump 72 that the pump tilt control section 73*a* has computed (i.e., the physical quantity associated with the delivery rate of the fluid from the hydraulic pump 72) is used to calculate a control parameter as a value that can be changed according to the tilt angle. The calculated control parameter is added to the pressure of the lower-pressure hydraulic line, after which a compensation pressure is calculated. In the compensation pressure computing unit 73*b*-2, a relation between the pump tilt angle and the control parameter Ps, as with the relation between the motor speed and control parameter Ps shown in FIG. 14, is determined in the form of at least one of a map and an approximation formula. This relation is then used in substantially the same manner as that of FIG. 14 to compute the control parameter as the value changeable according to the tilt angle.

If the delivery rate of the fluid from the bidirectionally tiltable hydraulic pump 72 significantly fluctuates under the effect of the rotational speed of the engine 71 fluctuating, the rotational speed of the engine 71 may also be imparted to the compensation pressure computing unit 73*b*-2. The imparted value is then used to calculate the pump fluid delivery rate. The control parameter Ps is determined on the basis of the calculated pump fluid delivery rate in the form of at least one of a map and an approximation formula.

The compensation pressure computing unit 73*b*-2, pressure level assessment unit 73*b*-3, control signal computing unit 73*b*-4, and output unit 73*b*-5 in the present embodiment are the same as those of the first and second embodiments in that the calculated control parameter Ps is first added for pressure determination and then the control signal 23 is given to the flushing valve 16.

In addition, the present embodiment may be applied to a machine in which a flow rate of the fluid delivered from the hydraulic pump 72 is increased by extending the tilt angle of the pump 72 at the timing of the load reversal in order to inhibit the speed of the hydraulic cylinder 11 from decreasing when the load reversal occurs to cause the control-side pressure chamber to switch over as in the first embodiment described with reference to FIG. 13. Thus, the hydraulic cylinder 11 can be held at a constant speed and the operability of the cylinder 11 can be enhanced even after the load has reversed. The tilt angle of the hydraulic pump 72 at this time may be converted from the pressure-receiving area sizes of the head-side pressure chamber 24 and the rod-side pressure chamber 25 with the moving direction of the hydraulic cylinder 11 taken into consideration. This control can be conducted with the use of the pump tilting direction/tilt angle control unit 73*a*-1. Whether the load has reversed can be recognized from a result of the assessment by the pressure level assessment unit 73*b*-3.

In this manner, even when the driving source is the engine 71, the system configuration according to the present embodiment allows the operation of the flushing valve 16 to be stabilized and the operability of the hydraulic cylinder 11 to be enhanced.

Fourth Embodiment

Still another embodiment of the present invention that employs a single rod type hydraulic cylinder in a hydraulic closed circuit system will be described below.

Figure 18:
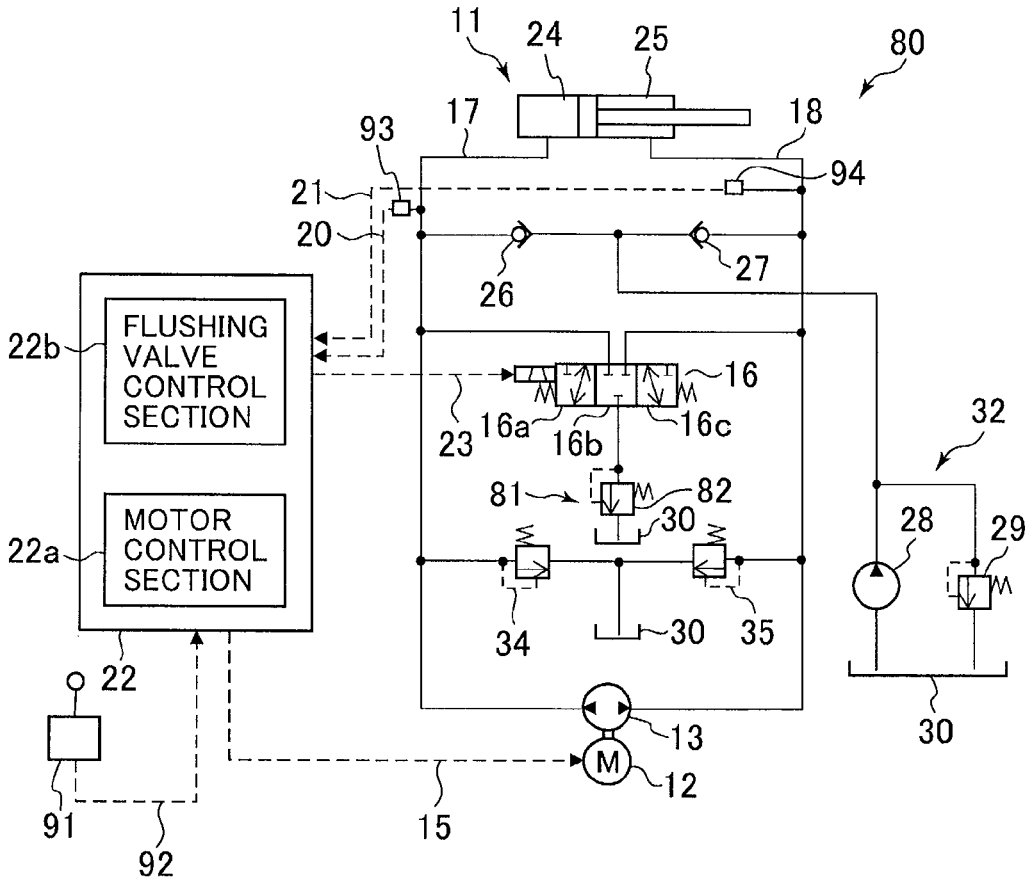
FIG. 18 shows a hydraulic closed circuit system according to a fourth embodiment of the present invention.

FIG. 18 shows the hydraulic closed circuit system 80 of the present embodiment. Of the hydraulic closed circuit system 80 shown in FIG. 18, elements assigned the same reference numbers in the above-described figures, and elements having the same functions as in the figures are omitted from FIG. 18.

The hydraulic closed circuit system of the present embodiment differs from the hydraulic closed circuit system 10 of FIG. 1 in that the flushing valve 16 has its output port connected to a tank circuit 81 instead of to the charge circuit 32. The tank circuit 81 includes a lower-pressure relief valve 82, and the output port of the flushing valve 16 is connected to the tank 30 via the lower-pressure relief valve 82. Upon the flushing valve 16 switching to the position 16*a* or 16*c* and a pressure from the output port going over a pressure setting of the lower-pressure relief valve 82, the relief valve 82 opens and the hydraulic operating fluid is discharged from the circuit of the lower-pressure side into the tank 30.

In the present embodiment, the flushing valve 16 only discharges a surplus flow from the circuit of the lower-pressure side and does not supply additional fluid to compensate for an deficit of a fluid flow in that circuit. The additional fluid for compensating for the deficit of the fluid flow in the circuit of the lower-pressure side is supplied from the charge circuit 32 via the check valves 26, 27.

The control signal 23 sent from the controller 22 switches the flushing valve 16, as in the first embodiment.

As described above, even when the flushing valve 16 only discharges a surplus flow from the circuit of the lower-pressure side, switching the flushing valve 16 according to the control signal 23 from the controller 22 allows the operation of the flushing valve 16 to be stabilized and the operability of the hydraulic cylinder 11 to be enhanced.

DESCRIPTION OF REFERENCE NUMERALS

10 Hydraulic closed circuit system
11 Single rod type hydraulic cylinder
12 Electric motor
13 Bidirectionally rotatable hydraulic pump
15 Control signal
16 Flushing valve
17, 18 Hydraulic lines
20, 21 Pressure detection signals
22 Controller
22*a* Electric motor control section
22*a*-1 Motor rotating direction/speed computing unit
22*a*-2 Output unit
22*b* Flushing valve control section
22*b*-1 Lower-pressure determining unit
22*b*-2 Compensation pressure computing unit
22*b*-3 Pressure level assessment unit
22*b*-4 Control signal computing unit
22*b*-5 Output unit
23 Control signal
24 Head-side pressure chamber of hydraulic cylinder
25 Rod-side pressure chamber of hydraulic cylinder
26, 27 Check valves
28 Charge pump
29 Relief valve
30 Tank
32 Charge circuit
34, 35 Relief valves
50 Hydraulic excavator
51 Boom
52 Arm
53 Bucket
60 Hydraulic closed circuit system
61 Filter
70 Hydraulic closed circuit system
71 Engine (Prime mover)
72 Bidirectionally tiltable pump
73 Controller
73*a* Pump tilt control section
73*b* Flushing valve control section
78 Regulator
80 Hydraulic circuit system
81 Tank circuit
82 Lower-pressure relief valve
91 Control lever device
92 Operating command signal
93, 94 Pressure sensors

The invention claimed is:

1. A hydraulic closed circuit system, comprising:
a prime mover;
a hydraulic pump driven by the prime mover and adapted to deliver a hydraulic fluid in two directions;
a single rod type hydraulic cylinder connected to the hydraulic pump via a first hydraulic line and a second hydraulic line to form a closed circuit;
a tank;
a flushing valve connected between the first and second hydraulic lines and the tank;
a charge circuit connected to a lower pressure side hydraulic line of the first and second hydraulic lines by switching of the flushing valve, the charge circuit including a charge pump connected to the first and second hydraulic lines and the tank to supply a hydraulic fluid to each of the first and second hydraulic lines from the tank, and a relief valve connected to the charge pump and the tank to maintain the charge pump at a predetermined pressure; and
a control unit configured to;
determine which of the first and second hydraulic lines is the lower-pressure side hydraulic line,
add a predetermined control pressure to a pressure in the lower-pressure side hydraulic line determined by the first determining section to compute a compensation pressure,
compare a magnitude of a pressure in a higher-pressure side hydraulic line of the first and second hydraulic lines with a magnitude of the compensation pressure, and
compute a command value to control the flushing valve to connect to one of the first and second hydraulic lines determined by the comparison as the lower-pressure side hydraulic line.

2. The hydraulic closed circuit system according to claim 1, further comprising:
an operating device that instructs operation of the hydraulic cylinder;
wherein the control unit is further configured to:
control a delivery rate and delivery direction of the hydraulic fluid from the hydraulic pump in accordance with an instruction from the operating device, and
determine to which of pressures in the first and second hydraulic lines the predetermined control pressure is to be added when the operating device instructs an operational start of the hydraulic cylinder or a change of a direction in which the hydraulic cylinder operates.

3. The hydraulic closed circuit system according to claim 1, wherein the control unit is further configured to calculate the predetermined control pressure as a variable value that changes according to at least one of a delivery rate of the hydraulic fluid from the hydraulic pump and a physical quantity associated with the delivery rate of the hydraulic fluid from the hydraulic pump.

4. The hydraulic closed circuit system according to claim 1, wherein the control unit is further configured to calculate the predetermined control pressure from a map or approximation formula relating to at least one of a delivery rate of the hydraulic fluid from the hydraulic pump and a physical quantity associated with the delivery rate of the hydraulic fluid from the hydraulic pump.

5. The hydraulic closed circuit system according to claim 1, wherein the control unit is further configured to hold a value of the predetermined control pressure at zero until at least one of a delivery rate of the hydraulic fluid from the hydraulic pump and the physical quantity associated with the delivery rate of the hydraulic fluid from the hydraulic pump has exceeded a predetermined value.

6. The hydraulic closed circuit system according to claim 1, wherein the prime mover is an electric motor and the hydraulic pump is a fixed-capacity type of pump.

7. The hydraulic closed circuit system according to claim 1, wherein the prime mover is a diesel engine and the hydraulic pump is a bidirectionally tiltable pump.

8. A hydraulic closed circuit system, comprising:

a prime mover;

a hydraulic pump driven by the prime mover and adapted to deliver a hydraulic fluid in two directions;

a single rod type hydraulic cylinder connected to the hydraulic pump via a first hydraulic line and a second hydraulic line to form a closed circuit;

a tank;

a flushing valve connected between the first and second hydraulic lines and the tank;

a charge circuit connected to a lower pressure side hydraulic line of the first and second hydraulic lines by switching of the flushing valve, the charge circuit including a charge pump connected to the first and second hydraulic lines and the tank to supply a hydraulic fluid to each of the first and second hydraulic lines from the tank, and a relief valve connected to the charge pump and the tank to maintain the charge pump at a predetermined pressure; and a control unit configured to;

determine which of the first and second hydraulic lines is the lower-pressure side hydraulic line, add a predetermined control pressure to a pressure in the lower-pressure side hydraulic line determined by the first determining section to compute a compensation pressure, compare a magnitude of a pressure in a higher-pressure side hydraulic line of the first and second hydraulic lines with a magnitude of the compensation pressure, and compute a command value to control the flushing valve to connect to one of the first and second hydraulic lines determined by the comparison as the lower-pressure side hydraulic line, and wherein the control unit is further configured to increase a delivery rate of the hydraulic fluid from the hydraulic pump such that the hydraulic cylinder moves at a constant speed when the flushing valve is controlled to be connected to the lower pressure side hydraulic line.

9. The hydraulic closed circuit system according to claim 8, further comprising:

an operating device that instructs operation of the hydraulic cylinder;

wherein the control unit is further configured to:

control a delivery rate and delivery direction of the hydraulic fluid from the hydraulic pump in accordance with an instruction from the operating device, and determine to which of pressures in the first and second hydraulic lines the predetermined control pressure is to be added when the operating device instructs an operational start of the hydraulic cylinder or a change of a direction in which the hydraulic cylinder operates.

10. The hydraulic closed circuit system according to claim 8, wherein the control unit is further configured to calculate the predetermined control pressure as a variable value that changes according to at least one of a delivery rate of the hydraulic fluid from the hydraulic pump and a physical quantity associated with the delivery rate of the hydraulic fluid from the hydraulic pump.

11. The hydraulic closed circuit system according to claim 8, wherein the control unit is further configured to calculate the predetermined control pressure from a map or approximation formula relating to at least one of a delivery rate of the hydraulic fluid from the hydraulic pump and a physical quantity associated with the delivery rate of the hydraulic fluid from the hydraulic pump.

12. The hydraulic closed circuit system according to claim 8, wherein the control unit is further configured to hold a value of the predetermined control pressure at zero until at least one of a delivery rate of the hydraulic fluid from the hydraulic pump and the physical quantity associated with the delivery rate of the hydraulic fluid from the hydraulic pump has exceeded a predetermined value.

13. The hydraulic closed circuit system according to claim 8, wherein the prime mover is an electric motor and the hydraulic pump is a fixed-capacity type of pump.

14. The hydraulic closed circuit system according to claim 8, wherein the prime mover is a diesel engine and the hydraulic pump is a bidirectionally tiltable pump.

* * * * *